US008459997B2

(12) United States Patent
Carter

(10) Patent No.: US 8,459,997 B2
(45) Date of Patent: Jun. 11, 2013

(54) SHOOTING SIMULATION SYSTEM AND METHOD

(75) Inventor: George Carter, Lucas, TX (US)

(73) Assignee: Opto Ballistics, LLC, Dallas, TX (US)

( * ) Notice: Subject to any disclaimer, the term of this patent is extended or adjusted under 35 U.S.C. 154(b) by 629 days.

(21) Appl. No.: 12/608,820

(22) Filed: Oct. 29, 2009

(65) Prior Publication Data

US 2010/0221685 A1 Sep. 2, 2010

Related U.S. Application Data

(60) Provisional application No. 61/156,154, filed on Feb. 27, 2009.

(51) Int. Cl.
*F41G 3/26* (2006.01)

(52) U.S. Cl.
USPC ..... 434/19; 434/11

(58) Field of Classification Search
USPC ..... 434/11–27; 463/5, 51; 102/529; 703/6; 42/1.01
See application file for complete search history.

(56) References Cited

U.S. PATENT DOCUMENTS 5,215,462 A * 6/1993 Lewis et al. ..... 434/19
6,813,593 B1 * 11/2004 Berger ..... 703/6
6,899,539 B1 * 5/2005 Stallman et al. ..... 434/11
7,329,127 B2 * 2/2008 Kendir et al. ..... 434/21

* cited by examiner

*Primary Examiner* — Timothy A Musselman
(74) *Attorney, Agent, or Firm* — Michael Diaz

(57) ABSTRACT

A shooting simulation system and method. The system includes a plurality of firearms. Each firearm is held by a separate player and includes a man-worn computer, an optical system associated with the firearm for capturing an image. The image provides information on a trajectory of a simulated bullet fired from a shooting firearm. The system determines if the captured image is a hit or a miss of targeted player and informs a man-worn computer of the targeted player of a hit by the shooting firearm. The determination if the captured image is a hit or miss and identity of the targeted player may include utilizing various types of information, such as the location of the shooting firearm and the targeted player, orientation of the shooting firearm, trajectory of the projected ammunition of the shooting firearm, terrain data and atmospheric conditions.

26 Claims, 10 Drawing Sheets

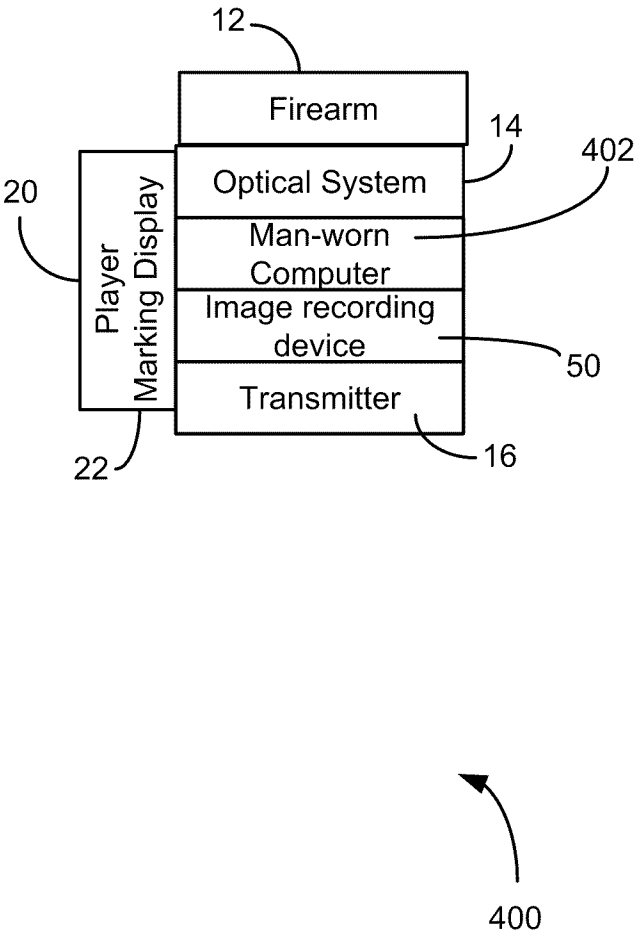
FIG. 6
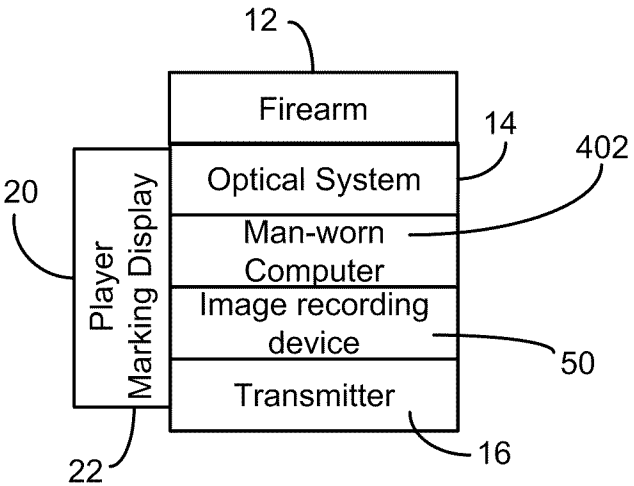

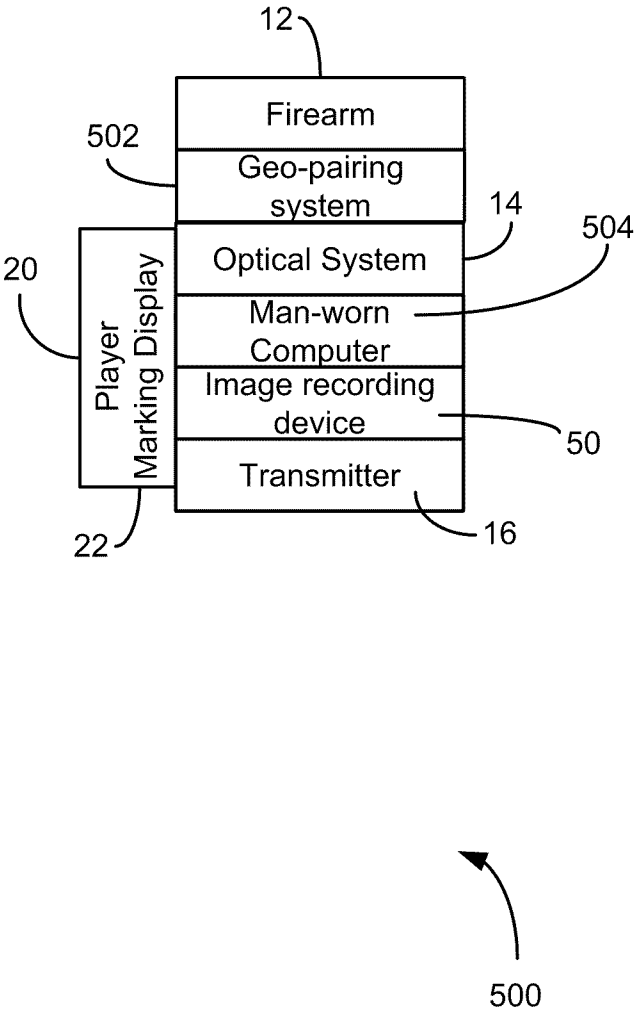
FIG. 7
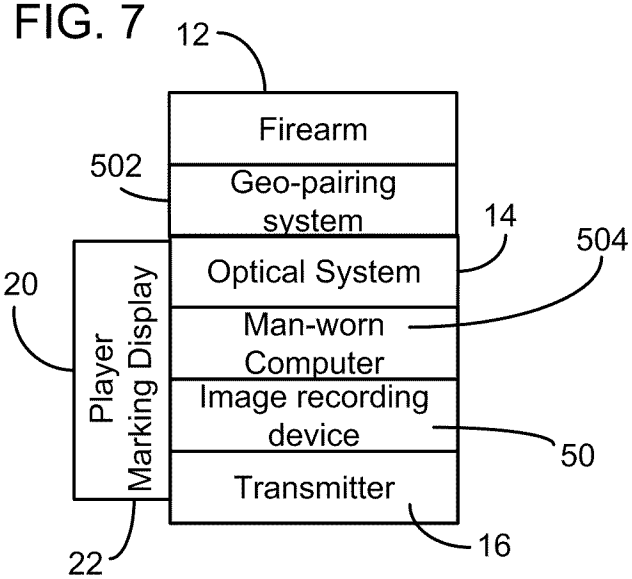

SHOOTING SIMULATION SYSTEM AND METHOD

RELATED APPLICATIONS

This utility application claims the benefit of U.S. Provisional Patent Application Ser. No. 61/156154 filed Feb. 27, 2009 by George Carter, which is hereby incorporated by reference.

BACKGROUND OF THE INVENTION

1. Field of the Invention

This invention relates to simulation systems and methods. Specifically, and not by way of limitation, the present invention relates to a shooting simulation system and method.

2. Description of the Related Art

Training of personnel is a necessary ingredient to create and maintain an effective fighting or law enforcement team. For the military, realistic training provides experience for soldiers prior to encountering actual real world combat. Training enables an individual to make mistakes prior to when the individual's or a teammate's life is at stake. Likewise, training in law enforcement is also helpful to enable the law enforcement officers to be properly prepared for various dangerous situations. Furthermore, training is useful in the development of effective tactics geared to a specific threat.

An important component of the training of these individuals is arms training. Specifically, the use of firearms to enhance or maintain shooting accuracy and in conjunction with operations involving other persons is particularly important. Infantry combat training has advanced in recent years with the use of computer and video simulations that teach marksmanship and situational awareness. However, despite this evolution, live on ground exercises are still considered to be the backbone of army training. This live force-on-force training is currently conducted using Multiple Integrated Laser Engagement System (MILES) where rifle fire is simulated by lasers.

The MILES system consists of an Infrared (IR) laser mounted and bore sighted on the rifle and IR sensors attached to the helmet and torso of the soldier. The laser beam from the rifle must have a dispersion angle such that the "spot" it projects is large enough that it cannot fall between the sensors and be undetected. However, the MILES simulated "bullet" has a much larger diameter (approximately ten inches at 250 yards) than an actual bullet. This can cause some shots to be scored as hits that, in reality, would be near misses while hits below the waist of a target soldier are scored as misses. Additionally, the laser beam does not curve toward the ground like a projectile. Furthermore, because of the speed of the laser beam, there is no need to "lead" a target as would be necessary in the real world.

Another problem with MILES, or any other receptor based system, is that competitive, young soldiers want to win the combat "game." This, in turn, may lead to cheating and dishonest tactics. The MILES system can be compromised by defeating or degrading the receptors worn by the soldier. Some of these techniques that soldiers have used to degrade the receptors' performance include assuming postures that expose less receptors, blocking receptors with their hands and arms, smearing receptors with mud, or even covering the receptors with tape. An unintended consequence of these techniques in the laser engagements may be that soldiers may lack a realistic respect for enemy fire.

The United States Army is well aware of these shortcomings. Therefore, the Army has developed One Tactical Engagement Simulation System (OneTESS) to augment, and eventually replace MILES. OneTESS proposes to use "electronic bullets" that are based on geo-pairing. The system is connected wirelessly and sensors communicate the position of the shooter and target as well as the weapon orientation at the time of the shot. From this data, who shot whom may be computed by a processing system. However, for line of sight rifle fire, the location and orientation sensors would have to be extremely precise to achieve the accuracy of laser systems. For example, a rifle orientation error of 0.1 degrees is the best accuracy of current feasible sensors. This would produce an error of 15 inches at a range of 250 yards, an error that is about double the current MILES system. OneTESS also requires accurate terrain data. OneTESS uses a Synthetic Natural Environment (SNE) database so that if a target is hidden behind an object or in a foxhole, a hit would not be scored. For most exercises, OneTESS would rely on Global Positioning System (GPS) to determine a player's position on the field. However, GPS systems have inherent error sources, such as atmospheric interference, multi-path RF signals and blockage by structures. In urban terrain, multi-path RF signals and blockage problems are more acute. Reliable positioning of the shooter and target by GPS will probably never be more accurate than plus or minus half a meter. Also, the GPS system would determine the location of the GPS unit worn or carried by the soldier. Since it cannot always be positioned at the center of visual mass of the soldier, an additional error of several inches is also introduced.

Thus, it would be advantageous to have a system which incorporates an optical recognition system with OneTESS to provide a more accurate and realistic training system. Additionally, it would be advantageous to have an optical recognition system and method which provides a simple optical recognition system for use in firearm simulation exercises. It is an object of the present invention to provide such a system and method.

SUMMARY OF THE INVENTION

In one aspect, the present invention is directed to a shooting simulation system. The system includes a plurality of firearms. Each firearm is held by a separate player and includes a man-worn computer and an optical system associated with the firearm for capturing an image. The image provides information on a trajectory of a simulated bullet fired from a shooting firearm. The system determines if the captured image is a hit or a miss of a targeted player and informs the targeted player of a hit by the shooting firearm. The determination if the captured image is a hit or miss and identity of the targeted player may utilize various types of information, such as the location of the shooting firearm and the targeted player, orientation of the shooting firearm, trajectory of the projected ammunition of the shooting firearm, terrain data and atmospheric conditions.

In another aspect, the present invention is directed to a method of simulating firearm use between a plurality of firearms. The method begins by a player pulling a trigger of a shooting firearm. The shooting firearm is aimed at targeted player. An image is then captured by an optical system associated with the shooting firearm. The image provides information on a trajectory of a simulated bullet fired from the shooting firearm. It is then determined if the captured image is a valid hit or a miss of the targeted player. Upon determining that the captured image is a valid hit, the targeted player is informed of a hit by the shooting firearm. The step of determining if the captured image is a hit or miss may include utilizing various types of information, such as the location of the shooting firearm and the targeted player, orientation of the shooting firearm, trajectory of the projected ammunition of the shooting firearm, terrain data and atmospheric conditions.

BRIEF DESCRIPTION OF THE DRAWINGS

FIG. 6 is a block diagram of components of a shooting simulation system in a third embodiment of the present invention.

FIG. 7 is a simplified block diagram of the components of a Hybrid Non-Laser Pairing System (NLPS) in a fourth embodiment of the present invention.

DESCRIPTION OF THE INVENTION

Figure 1:
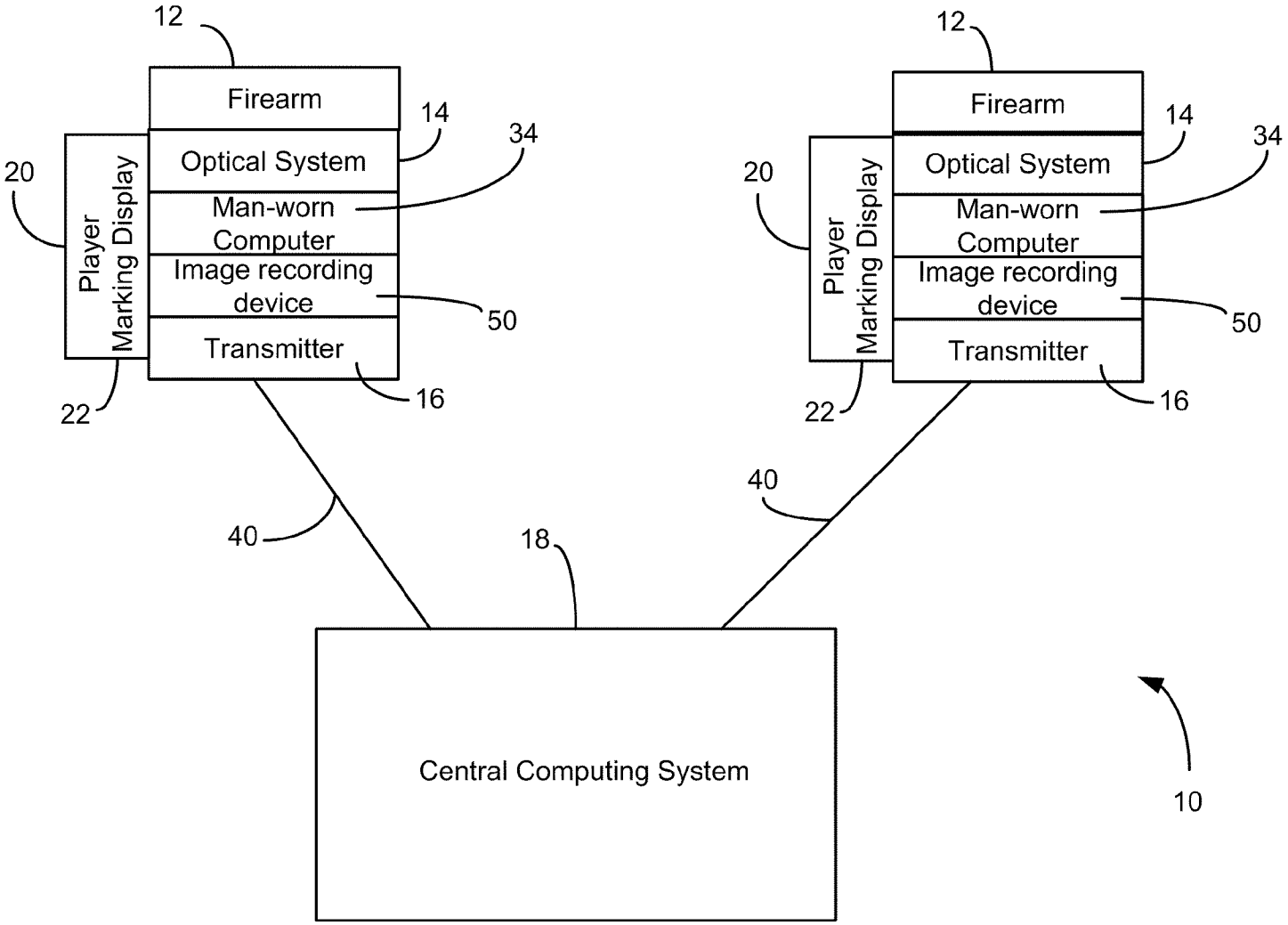
FIG. 1 is a block diagram of components of a shooting simulation system in a first embodiment of the present invention.

The present invention is a shooting simulation system and method. FIG. 1 is a block diagram of components of a shooting simulation system 10 in a first embodiment of the present invention. The system includes a firearm 12, an optical system 14, and a wireless transmitter 16. The system also includes a central computing system 18. In one embodiment, each player 20 wears an indicia 22 or any type of indicia to include color codes, bar codes, shape of helmet, shape of typical person's face, infrared signature, and other spectral images.

Figure 2:
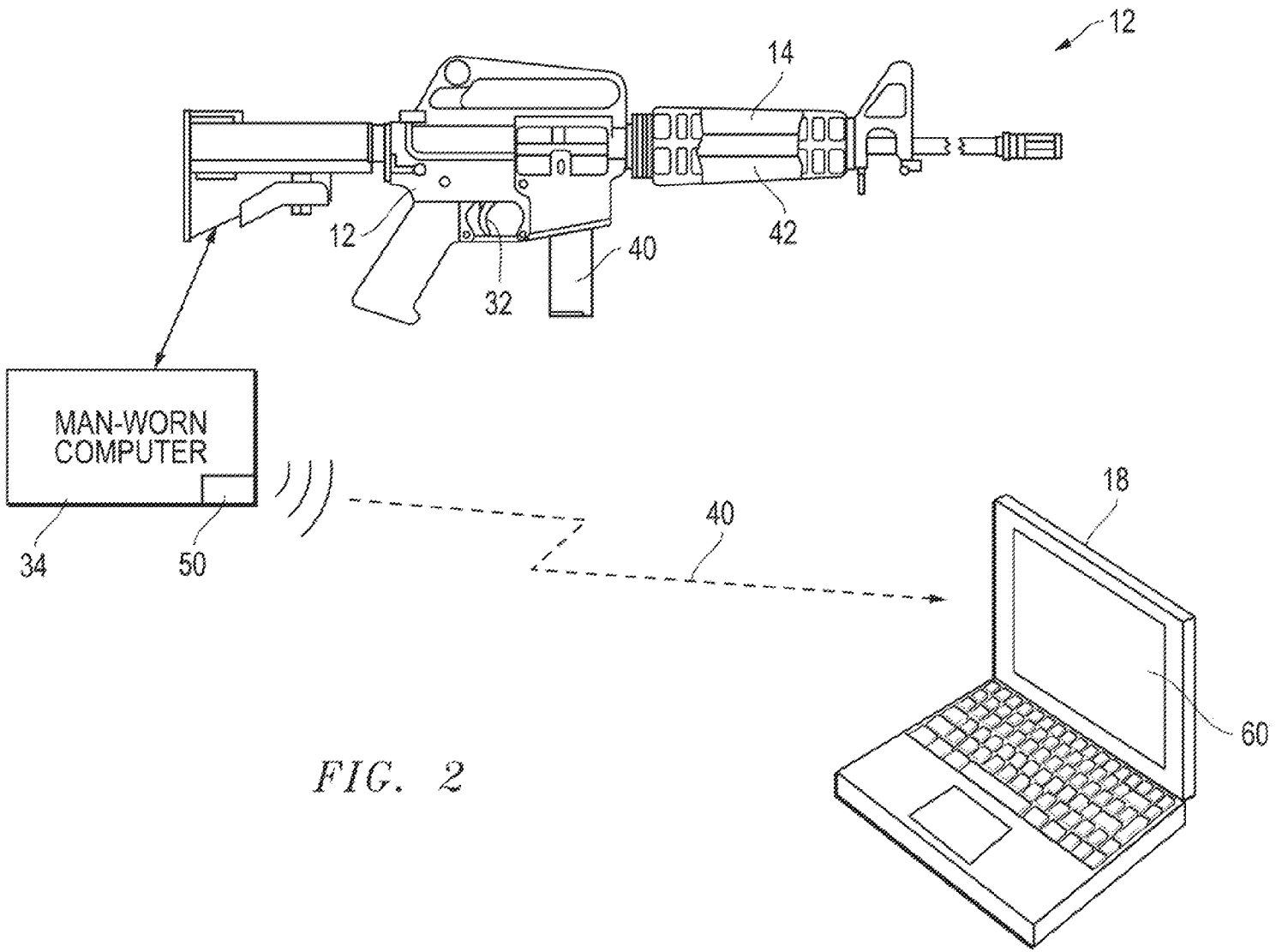
FIG. 2 is a front view of the firearm and central computing system in one embodiment of the present invention.

FIG. 2 is a front view of the firearm 12 and computing system 18 in one embodiment of the present invention. As depicted in FIG. 2, the firearm is a pistol having the optical system 14 mounted and bore-sighted to a pistol barrel 30. The firearm 12 includes a trigger 32. In addition, the user carrying the firearm may wear a man-worn computer 34 (see FIG. 1). The man-worn computer may be any device having a processor. The wireless transmitter and optical system may also be located within the man-worn computer or integrated within the firearm 12. The man-worn computer includes components which may or may not be separate from the firearm. If the man-worn computer is separate from the firearm, the firearm communicates with the man-worn computer through a cable or wireless link. In another embodiment, all or some of the components of the man-worn computer are integrated into the firearm. The firearm may be any type of weapon, such as a pistol, rifle, shotgun, rocket propelled grenade launcher (RPG), bazooka, or any other line-of-sight weapon carried by an individual or mounted upon a vehicle. The firearm may be an authentic replica weapon or an operable weapon having the optical system, and transmitter mounted to the weapon. The wireless transmitter may be any device which transmits data via a communications link 40 to the central computing system, such as a standard 801.11b wireless connection, a Bluetooth connection, etc. In addition, the firearm or man-worn computer may include a rangefinder 42 for ranging the distance from the firearm to the target. Additionally, each firearm may emit an infrared beam in several directions from the firearm. This emitted infrared beam may be used for verification of an actual target. The target may be a player or a vehicle for which the player is located (e.g., a tank or vehicle). For example, when the player actuates the trigger, the presence of the infrared beam from the target's firearm may be used for verification of a valid target.

The optical system 14 includes an image recording device 50 (see FIG. 1) having an optical image capturing device (e.g., a camera) (mounted on the firearm) which captures an image when the trigger is actuated. The optical system is aligned relative to a known orientation or site of the firearm and captures an image when the trigger 32 is actuated. The image is then captured and recorded in the image recording device 50. In one embodiment, the firearm may be equipped with an Inertial Navigation System (INS) which incorporates gyroscopes, magnetometers, accelerometers, or other sensors to determine the inclination and heading of the barrel, the location of the firearm, acceleration or movement of the firearm and other relational information of the firearm. Furthermore, the firearm or man-worn computer may incorporate a Global Positioning System (GPS) to locate the firearm. With the use of more than one antenna, a heading and inclination of the barrel may be ascertained. The optical system incorporates an image recognition program. The optical system includes ballistic data for bullets which would be fired from the firearm. The optical system 14 may be located in the firearm or portions of the optical system, with the exception of the optical image capturing device (e.g., a camera), may be separate from the firearm but carried by the player (e.g., in the man-worn computer.

The image recognition program residing in the firearm 12 or man-worn computer determines if a hit or miss is awarded for the captured image. In particular, the image recognition program may process the image by determining if the captured image is recognized as a legitimate target, such as a human figure or target vehicle.

The firearm or man-worn computer may also include an aural system (not shown), which may be incorporated in the firearm itself or a headset worn by the player. The aural system may provide an indication of when a hit has been scored against the player, a realistic noise simulating the firing of a gun, or bullets approaching. Furthermore, the firearm may include a Light Emitting Diode (LED) array or other illumination system which illuminates the trigger is actuated to simulate a muzzle blast. The firearm may also utilize machine recognizable markings which provide an identification of the gun. In addition, the firearm may utilize multiple optical sets for long or short range. The optical system may also utilize an infrared system, night vision system, or other spectral imaging system for use at night or in reduced visibility.

The optical system determines, through its image recognition program, if the image is a recognizable target (i.e., a human form). The optical system may utilize several sources of information to verify the validity of the target. Furthermore, the optical system includes ballistic data of a projected firing of a bullet to determine where the bullet would hit. The presence of the indicia 22 or a detected infrared emission of the opposing player may be used to determine if the target is a valid target. Furthermore, the optical system may utilize other mechanisms for detecting other types of spectral images. In one embodiment, the central computer or man-worn computer (processor) knows the range between the firearm and the target. In addition, the rangefinder may optionally be used to determine an accurate projected trajectory of the bullet (i.e., the bullet ballistics) for the particular target at a determined range. As discussed above, the determination of a hit or miss within the optical system may utilize various forms of data. The orientation of the gun which may include the inclination of the firearm, the distance to the target, weather conditions (wind, altitude, etc.), movement of the gun, etc. are all used to determine the trajectory of the bullet. The calculated bullet's trajectory is then used to determine where the bullet would have hit, and from the determination of the bullet's destination, a determination of a hit or miss is accomplished. The man-worn computer 34 may utilize various navigation and motion systems to collect data for accurate determination of the bullet's trajectory and/or location of the player, such as GPS or INS. The optical system then records the captured image as a hit or a miss based on the image recognition programs determination. This information may then be transmitted to the central computing system via the communications link 40. The transmittal of this data as well as the location of the firearm and inclination and heading of the barrel of the firearm may be at a predetermined time period or by a command issued from the central computing system.

In one embodiment, the captured image and any relevant data are sent to the central computing system 18 via the wireless communication link 40. The central computing system may include a display screen 60 and a receiver (not shown) to receive the transmitted image and relevant data. The central computer contains a geo-positioning program for verifying the position of each player in play as well as management of a wireless network encompassing the plurality of players 20 having firearms 12. The central computing system knows where each player is located, the heading and inclination of the barrel, the distance from the firearm to the target and utilize this information to provide further verification of whether an attempted shot is a valid hit by considering the geometry of the bullet trajectory and the position of the target. Although the central computing system may determine a hit, the image recognition system may ascertain that a valid target is not in the captured image. This would occur if a player is located behind an object, preventing the passage of the bullet to the target.

With reference to FIGS. 1 and 2, the operation of the system 10 will now be explained. A plurality of players 20 enters an area of operation. Each player carries a firearm 12 and man-worn computer. In the preferred embodiment of the present invention, each player wears the indicia 22 and/or emits infrared light to facilitate ease in recognition by the optical system's recognition program of a legitimate target and which team the player is affiliated. Furthermore, the indicia 22 may be used to individually identify each player. A player observes another player on the opposing team, aligns the firearm in a similar fashion as if the player was aiming the firearm to actually fire. The player, upon determining that the firearm is correctly aimed, actuates the trigger 32. The optical system 14 captures the image and optionally any relevant data related to the estimated trajectory of the bullet (e.g., wind, altitude, motion, etc.). The captured image is then processed within the man-worn computer to include determination of a hit or miss of the intended target (i.e., player or vehicle).

The optical system or man-worn computer determines, through its image recognition program, if the image is a recognizable target (e.g., a human form or vehicle). The optical system or man-worn computer may utilize several sources of information to verify the validity of the target. Furthermore, the optical system includes ballistic data of a projected firing of a bullet to determine where the bullet would hit. The presence of the indicia 22 or a detected infrared emission of the opposing player may be used to determine if the target is a valid target. Furthermore, the optical system may utilize other ancillary identifiers to determine if the intended target is valid, such as detecting specific patterns or shapes (e.g., helmet, human face, assault rifle, camouflage clothing, boots, etc.). In addition, the rangefinder may optionally be used to determine an accurate projected trajectory of the bullet (i.e., the bullet ballistics) for the particular target at a determined range. In addition, the optical system may utilize other mechanisms for detecting other types of spectral images of the intended target. As discussed above, the determination of a hit or miss within the optical system may utilize various forms of data. The inclination and orientation of the barrel of the gun, distance to the target, weather conditions (wind, altitude, etc.), movement of the gun, etc. are all used to determine the trajectory of the bullet. The calculated bullet's trajectory is then used to determine where the bullet would have hit, and from the determination of the bullet's destination, a determination of a hit or miss is accomplished. The firearm may utilize various navigation and motion systems to collect data for accurate determination of the bullet's trajectory and/or location of the player, such as GPS or INS. The optical system then records the captured image as a hit or a miss based on the image recognition programs determination. This information may then be transmitted to the central computing system via the communications link 40. This data, as well as the location of the firearm, the heading and inclination of the barrel, and distance from the firearm to the target, may be sent at a predetermined time period or by a command issued from the central computing system.

The central computing system receives this data and may independently determine/verify a hit or miss of the target. Since the central computing system includes the position of each player and the information on the triggered firearm (e.g., heading and inclination of barrel, distance to target, etc.), the central computing system may determine/verify a hit or miss. The central computing system then manages the location of all the players as well as compiling all the hits and misses of each player at a specific location and time during the simulation. This compilation may be used for debrief of the players and determination of the success of each player and each team. The central computing system may compile such data as time of firing, accuracy, number of bullets fired, times the player is targeted, etc. In one embodiment, the central computing system may provide a playback of each encounter providing a graphical representation of each player, trajectory of the bullets, etc. In addition, the computing system may capture images which are enhanced by infrared detection or night vision systems enabling optical image pickup in reduced visibility. Furthermore, the central computing system may send back information on a hit or miss to the intended target. For example, the target (player) may be informed that he is killed by receiving an aural warning in a headset.

The present invention may also utilize an aural system to alert a player that the player has been hit or provide realistic sounds during the course of the game (e.g., firing of the firearm or bullets passing in close proximity to the player). The present invention may also include a Light Emitting Diode (LED) array or other illumination system which illuminates when the trigger is actuated to simulate a muzzle blast or when the player has been hit.

The optical system of an opposing force, simulating an untrained or a person having lower marksmanship skills may be degraded to a predetermined amount to simulate the degraded abilities of the opposing team in an actual situation. For example, if the opposing player is simulating a terrorist or criminal with limited firearms training, the optical system may program a degraded hit calculation to emulate the reality of the degraded capability of the player.

Figure 3A:
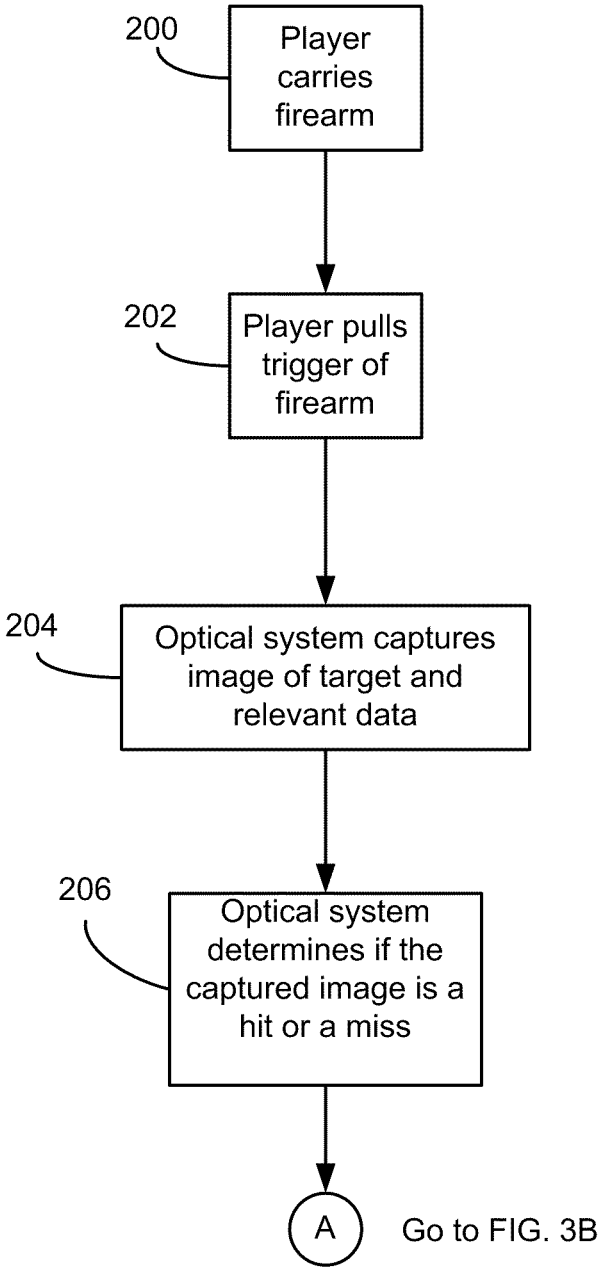
FIGS. 3A and 3B are flow charts illustrating the steps of simulating firearm use in a scenario according to the teachings of the present invention.
Figure 3B:
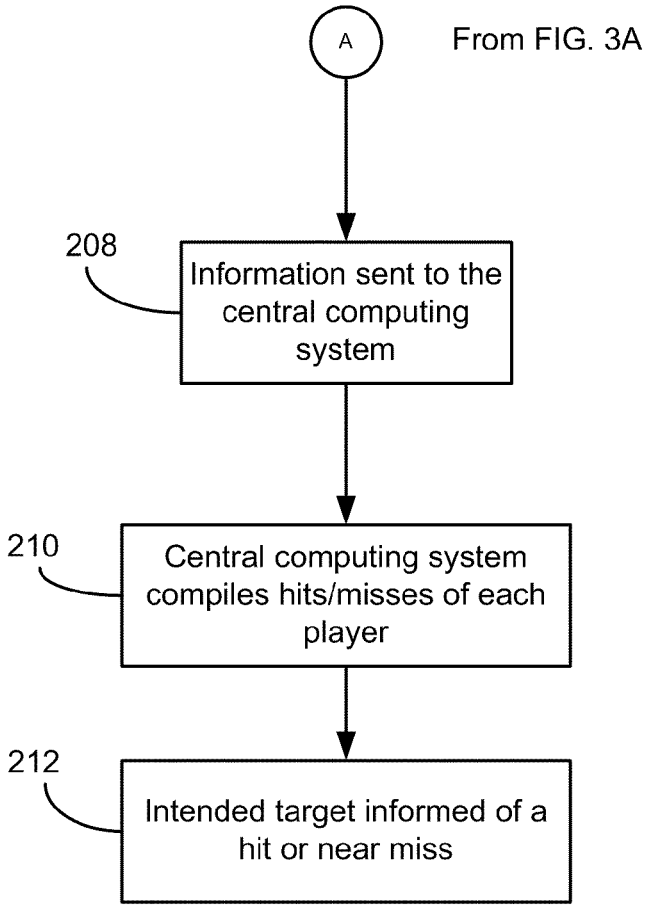

FIGS. 3A and 3B are flow charts illustrating the steps of simulating firearm use in a scenario according to the teachings of the present invention. With reference to FIGS. 1-3, the method will now be explained. In step 200, each player carries a firearm 12 and the man-worn computer 34. In one embodiment of the present invention, each player wears the indicia 22 and may transmit infrared beams to facilitate ease in recognition by the optical system's recognition program of a legitimate target. Next, in step 202, a player observes another player and when desired, aligns the firearm in a similar fashion as if the player was aiming the firearm to actually fire and actuates the trigger 32. In step 204, the optical system 14 captures the image and relevant data concerning the firearm and environment (e.g., alignment and inclination and heading of the barrel, any movement of the firearm, winds, altitude, etc.).

In step 206, the optical system or man-worn computer determines, through its image recognition program, if the image is a recognizable and valid target (i.e., a human form) and whether to score it as a hit or a miss. The optical system may utilize several sources of information to verify the validity of the target. Furthermore, the optical system includes ballistic data of a project firing of a bullet to determine where the bullet would hit. The presence of the indicia 22 or a detected infrared emission of the opposing player may be used to determine if the target is a valid target. In addition, the rangefinder may optionally be used to determine an accurate projected trajectory of the bullet (i.e., the bullet ballistics) for the particular target at a determined range. As discussed above, the determination of a hit or miss within the optical system may utilize various forms of data. The orientation (e.g., heading and inclination) of the barrel of the firearm, distance to the target, weather conditions (wind, altitude, etc.), movement of the firearm, etc. are all used to determine the trajectory of the bullet. The calculated bullet's trajectory is then used to determine where the bullet would have hit, and from the determination of the bullet's destination, a determination of a hit or miss of a valid target is accomplished. The computer within the firearm may utilize various navigation and motion systems to collect data for accurate determination of the bullet's trajectory and/or location of the firearm, such as GPS or INS. The optical system then records the captured image as a hit or a miss based on the image recognition programs determination. Furthermore, the optical system may utilize other ancillary identifiers to determine if the intended target is valid, such as detecting specific patterns (e.g., helmet, human face, assault rifle, camouflage clothing, boots, etc.).

Next, in step 208, this information (i.e., trigger actuations, results, etc.) may then be transmitted to the central computing system via the communications link 40. The transmittal of this data as well as the location of the player may be at a predetermined time period or by a command issued from the central computing system.

In step 210, the central computing system then manages the location of all the players as well as compiling all the hits and misses of each player at a specific location and time during the simulation. This compilation may be used for debrief of the players and determination of the success of each player and each team. The central computing system may compile such data as time of firing, accuracy, number of bullets fired, times the player is targeted, etc. In one embodiment, the central computing system may provide a playback of each encounter providing a graphical representation of each player, trajectory of the bullets, etc. In addition, the central computing system may independently determines/verifies a hit or miss of the target. Since the central computing system includes the position of each player and the information on the triggered firearm (e.g., heading and inclination of barrel, distance to target, etc.), the central computing system may determine/verify a hit or miss. In step 212, this verification of a hit or miss may be sent back to the intended target (i.e., the targeted player) to inform of a hit or a miss.

Figure 4:
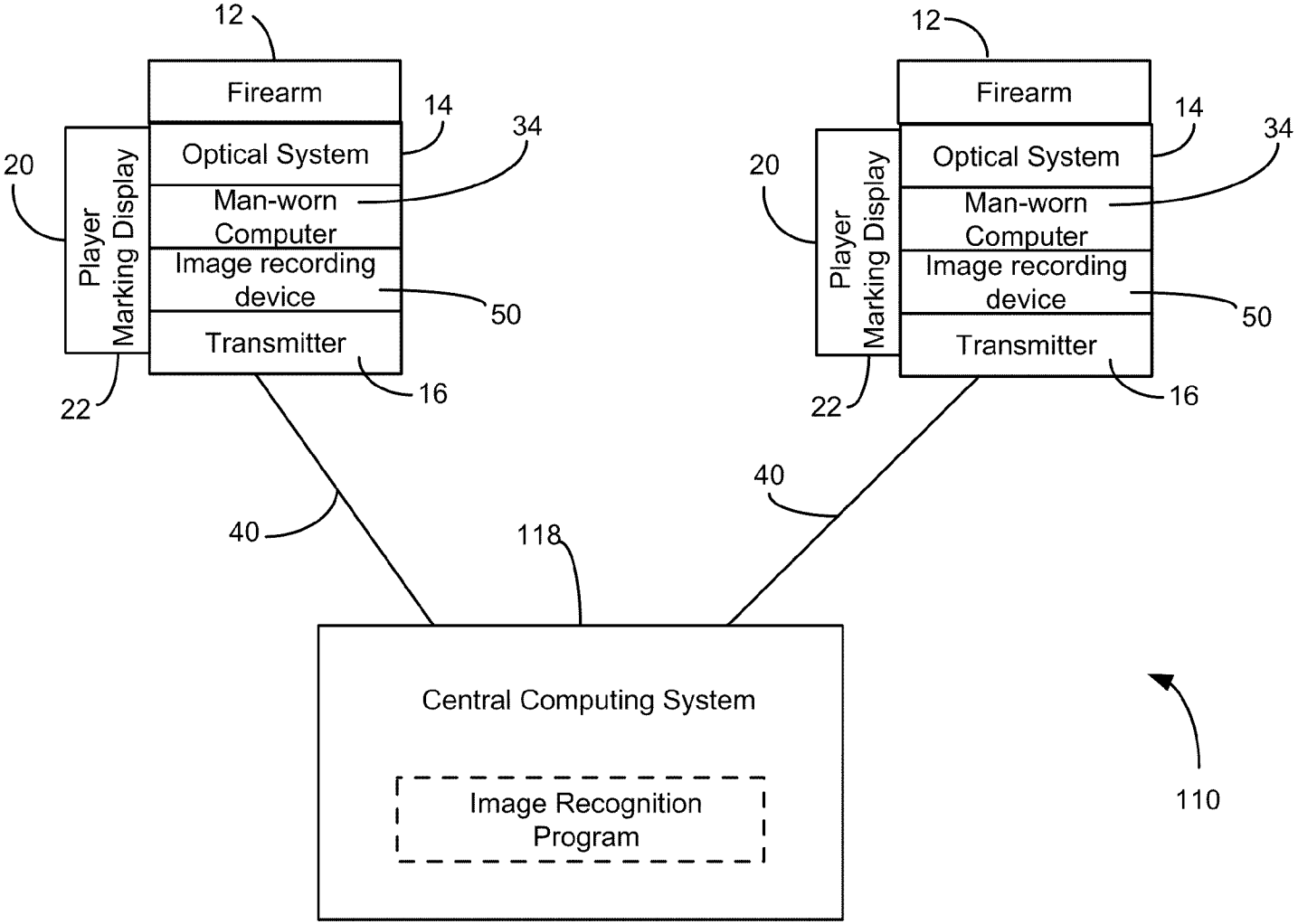
FIG. 4 is a block diagram of components of a shooting simulation system in a second embodiment of the present invention.

In another embodiment, the image recognition program and the functionality to determine a hit or miss may reside in the central computing system. FIG. 4 is a block diagram of components of a shooting simulation system 110 in a second embodiment of the present invention. The system includes the firearm 12, the man-worn computer 34, the optical system 14 and the wireless transmitter 16. The system also includes a central computing system 118. In one embodiment, each player 20 wears an indicia 22.

As discussed in FIGS. 1 and 2, the optical system aligns where a bullet would travel in front of the firearm and captures an image when the trigger 32 is actuated. The image is then captured and recorded in the image recording device 50. The optical system 14 may be located in the firearm or portions of the optical system, with the exception of the optical image capturing device (e.g., a camera), may be separate from the firearm but carried by the player (e.g., in the man-worn computer).

In the embodiment illustrated in FIG. 4, the captured image and any relevant data are sent to the central computing system 18 via the wireless communication link 40. The central computing system may include a display screen 60 and a receiver (not shown) to receive the transmitted image and relevant data. The central computer provides management of a wireless network encompassing the plurality of players 20 having firearms 12. The central computing system also records results of hits and misses of targets. The central computing system may also send commands to firearms providing ballistic programming that computes the trajectory of the bullet. Furthermore, the central computing system includes the image recognition program that determines if a hit or miss is award for the captured image. In particular, the image recognition program may process the image by determining if the captured image is recognized as a legitimate target, such as a human figure or target vehicle.

To facilitate if a captured image is a legitimate target, the present invention may optionally utilize indicia 22 or the infrared transmissions emitted from the target to validate the target. In addition, in a similar fashion as the system 10, information is obtained from several sources and utilized to verify a hit or miss. In particular, the central computing system receives information on the location of each firearm, the heading and inclination of the barrel of the firearm, the distance from the firearm to the target and the location of other firearms. All this geometric information may be used to determine if a hit or miss is to be scored. Furthermore, the central computer may utilize other ancillary identifiers to determine if the intended target is valid, such as detecting specific patterns (e.g., helmet, human face, assault rifle, camouflage clothing, boots, etc.).

With reference to FIGS. 2 and 4, the operation of the system 110 will now be explained. A plurality of players 20 enters an area of operation. Each player carries a firearm 12 and the man-worn computer 34. In the preferred embodiment of the present invention, each player wears the indicia 22 to facilitate ease in recognition by the optical system's recognition program of a legitimate target and which team the player is affiliated. A player observes another player on the opposing team, aligns the firearm in a similar fashion as if the player was aiming the firearm to actually fire. The player, upon determining that the firearm is correctly aimed, actuates the trigger 32. The optical system 14 captures the image and any relevant data related to the estimated trajectory of the bullet (e.g., wind, altitude, motion, etc.). In one embodiment, the captured image and relevant data is transmitted by the transmitter 16 to the central computing system 118 via the communications link 40. The man-worn computer may also transmit the location of the firearm and the heading and inclination of the barrel of the firearm (determined by GPS or INS) and the distance from the firearm to the target (determined by the rangefinder) to the central computing system.

The central computing system receives the transmitted captured image and determines through its image recognition program, if the image is a recognizable target (i.e., a human form). Furthermore, if the indicia 22 of the opposing player are used, the image recognition program can easily determine to which side the player is aligned as well as the individual player's identity. The central computing system 18 then records the captured image as a hit or a miss based on the image recognition programs determination. Furthermore, the central computing system may further verify if a hit or miss is to be scored by utilizing the positional information of the firearm firing and the intended target. The management of scores of hits and misses are then compiled by the central computing system. This compilation may be used for debrief of the players and determination of the success of each player and each team. The computing system may compile such data as time of firing, accuracy, number of bullets fired, times the player is targeted, etc. In one embodiment, the computing system may provide a playback of each encounter providing a graphical representation of each player, trajectory of the bullets, etc. In addition, the computing system may capture images which are enhanced by infrared detection or night vision systems enabling optical image pickup in reduced visibility. In addition, the computing system may provide an indication of a hit or miss to the intended target.

The determination of a hit or miss within the central computing system 18 or optionally within the man-worn computer 34 includes the use of various forms of data. The inclination of the gun, distance to the target, weather conditions (wind, altitude, etc.), movement of the gun, distance from firearm to target obtained from the rangefinder, etc. are all used to determine the trajectory of the bullet. The calculated bullet's trajectory is then used to determine where the bullet would have hit, and from the determination of the bullet's destination, a determination of a hit or miss of a valid target is accomplished. As discussed above, the firearm may utilize various navigation and motion systems to collect data for accurate determination of the bullet's trajectory and/or location of the player, such as GPS or INS.

Figure 5A:
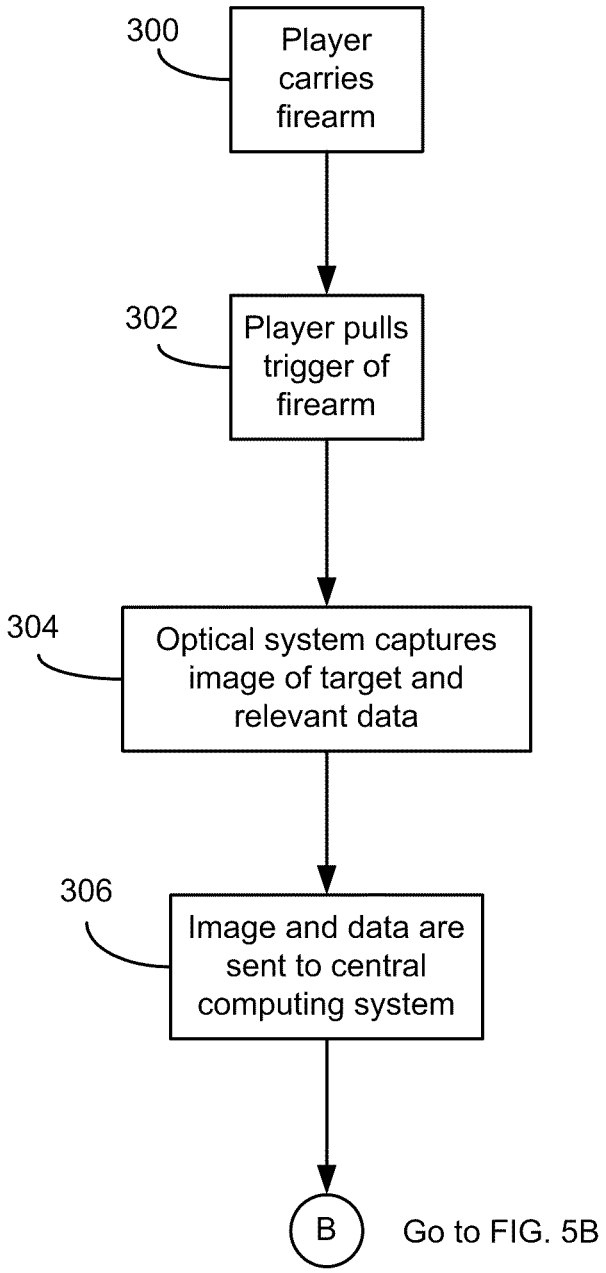
FIGS. 5A and 5B are flow charts illustrating the steps of simulating firearm use in a scenario in another embodiment of the present invention.
Figure 5B:
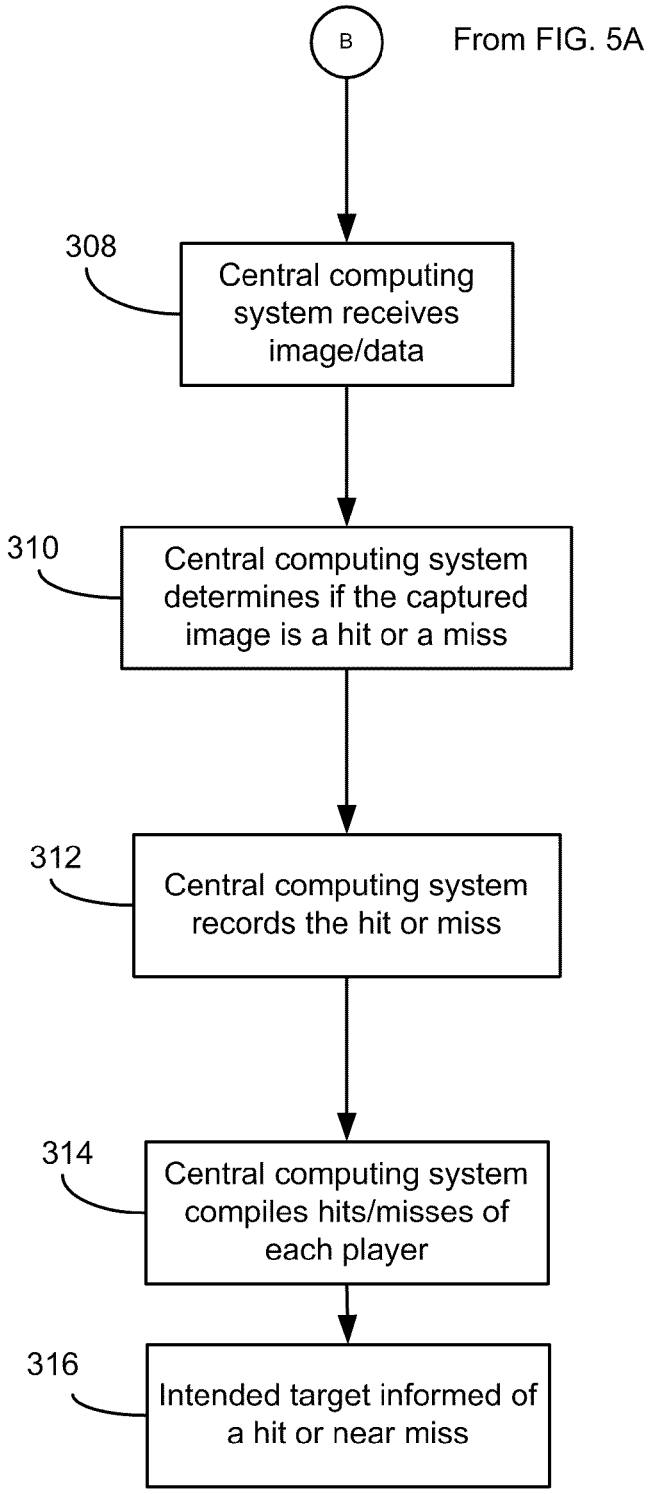

FIGS. 5A and 5B are flow charts illustrating the steps of simulating firearm use in another embodiment of the present invention. With reference to FIGS. 2, 4, and 5, the method will now be explained. In step 300, each player carries a firearm 12 and the man-worn computer 34. In the preferred embodiment of the present invention, each player wears the indicia 22 to facilitate ease in recognition by the optical system's recognition program of a legitimate target and to which team the player is affiliated. Next, in step 302, a player observes another player and when desired, aligns the firearm in a similar fashion as if the player was aiming the firearm to actually fire and actuates the trigger 32. In step 304, the optical system 14 captures the image and relevant data concerning the firearm and environment (e.g., alignment and inclination of the bore, any movement of the firearm, winds, altitude, etc.). In step 306, the captured image and data is transmitted by the transmitter 16 to the central computing system 118 via the communications link 40.

Next, in step 308, the central computing system receives the transmitted captured image. In step 310, the computing system determines, through its image recognition program, if the image is a recognizable and valid target (i.e., a human form) and whether to score it as a hit or a miss. The indicia 22 of the opposing player and/or the detection of emitted infrared light may be used to further verify the presence of a valid target. The orientation (e.g., inclination and orientation) of the barrel of the firearm, distance to the target, weather conditions (wind, altitude, etc.), movement of the firearm, distance from firearm to target, etc. are all used to determine the trajectory of the bullet. This information may also be sent to the central computing system. The calculated bullet's trajectory is then used to determine where the bullet would have hit, and from the determination of the bullet's destination, a determination of a hit or miss is accomplished. As discussed above, the firearm may utilize various navigation and motion systems to collect data for accurate determination of the bullet's trajectory and/or location of the player, such as GPS or INS.

Next, in step 312, the central computing system 118 then records the captured image as a hit or a miss based on the image recognition program's determination. In step 314, the management of scores of hits and misses are then compiled by the central computing system. This compilation may be used for debrief of the players and determination of the success of each player and each team. The computing system may compile such data as time of firing, accuracy, number of bullets fired, times the player is targeted, etc. In one embodiment, the computing system may provide a playback of each encounter providing a graphical representation of each player, trajectory of the bullets, etc. In addition, the computing system may capture images which are enhanced by infrared detection or night vision systems enabling optical image pickup in reduced visibility. Additionally, in step 316, the computing system may provide a signal or indication to the intended target of a hit or a near miss.

Although the present invention has illustrated the use of firearms, the present invention may also be incorporated in vehicles, such as tanks and armored personnel carriers. The computing system may determine the legitimacy of such targets in its image recognition program. In addition, the present invention may be used for various scenarios such as within law enforcement field or recreational field.

In another embodiment, the image recognition program and the functionality to determine a hit or miss may reside in the firearm 12 and without the use of a central computing system. FIG. 6 is a block diagram of components of a shooting simulation system 400 in a third embodiment of the present invention. The system includes the firearm 12 and the man-worn computer 402, the optical system 14, and the wireless transmitter 16. In one embodiment, each player 20 wears a indicia 22.

As discussed in FIGS. 1 and 2, the optical system aligns where a bullet would travel in front of the firearm and captures an image when the trigger 32 is actuated. The image is then captured and recorded in the image recording device 50. The optical system 14 may be located in the firearm or portions of the optical system, with the exception of the optical image capturing device (e.g., a camera), may be separate from the firearm but carried by the player (e.g., in the man-worn computer.

In the embodiment illustrated in FIG. 6, ascertaining whether the captured image should be scored as a hit or miss is determined by the shooting firearm's man-worn computer 402. The man-worn computer may be any device having a processor. In one embodiment, the shooting firearm 12 utilizes the image recognition program within the optical system 14 to process the image by determining if the captured image is recognized as a legitimate target, such as a human figure or target vehicle.

To facilitate if a captured image is a legitimate target, the present invention may optionally utilize indicia 22 or the infrared transmissions emitted from the target to validate the target. In addition, in a similar fashion as the system 10, information is obtained from several sources and utilized to verify a hit or miss. In particular, the computer 402 may receive information on the location of each firearm, the heading and inclination of the barrel of the firearm, the distance from the firearm to the target and the location of other firearms. All this geometric information may be used to determine if a hit or miss is to be scored. Furthermore, the optical system may utilize other ancillary identifiers to determine if the intended target is valid, such as detecting specific patterns (e.g., helmet, human face, assault rifle, camouflage clothing, boots, etc.).

With reference to FIGS. 2 and 6, the operation of the system 400 will now be explained. A plurality of players 20 enters an area of operation. Each player carries a firearm 12. In the preferred embodiment of the present invention, each player wears the indicia 22 to facilitate ease in recognition by the optical system's recognition program of a legitimate target and the specific identity of the person. A player observes another player and aligns the firearm in a similar fashion as if the player was aiming the firearm to actually fire. The player, upon determining that the firearm is correctly aimed, actuates the trigger 32. The optical system 14 captures the image and any relevant data related to the estimated trajectory of the bullet (e.g., wind, altitude, motion, etc.). The optical system and man-worn computer 402 determines, through its image recognition program, if the image is a recognizable target (i.e., a human form). Furthermore, if the indicia 22 of the targeted player are used, the image recognition program can easily determine the individual player's identity. The optical system then records the captured image as a hit or a miss based on the image recognition programs determination. Furthermore, the man-worn computer 402 may further verify if a hit or miss is to be scored by utilizing the positional information of the firearm firing and the intended target. The management of scores of hits and misses are then compiled by man-worn computer 402. This compilation may be used for debrief of the players and determination of the success of each player and each team. The man-worn computer 402 may compile such data as time of firing, accuracy, number of bullets fired, times the player is targeted, etc. In one embodiment, the man-worn computer may provide a playback of each encounter providing a graphical representation of each player, trajectory of the bullets, etc. In addition, the computer may capture images which are enhanced by infrared detection, night vision systems, or spectral imaging mechanisms enabling optical image pickup in reduced visibility. In addition, the computer may provide an indication of a hit or miss to the intended target. Specifically, the computer of the shooting firearm may transmit a signal to the target's firearm providing an indication of a hit or near miss of the target. The target's firearm may provide an aural or visual indicator (e.g., noise, beep, flashing light) to inform the user of the hit or near miss.

The determination of a hit or miss within the man-worn computer 402 includes the use of various forms of data. The inclination of the gun, distance to the target, weather conditions (wind, altitude, etc.), movement of the gun, distance from firearm to target obtained from the rangefinder, etc. are all used to determine the trajectory of the bullet. The calculated bullet's trajectory is then used to determine where the bullet would have hit, and from the determination of the bullet's destination, a determination of a hit or miss of a valid target is accomplished. As discussed above, the computer of the man-worn computer may utilize various navigation and motion systems to collect data for accurate determination of the bullet's trajectory and/or location of the player, such as GPS or INS.

In another embodiment, the present invention may utilize a geo-pairing system (e.g., the OneTESS wireless geo-pairing system), in conjunction with the optical shooting simulation system of the present invention. Geo-pairing utilizes a set of data about both the shooter and target, such as locations, weapon orientations, velocities, and weapon projectile velocities, nearby terrain to resolve an engagement. "Evolution of Live Training by the Implementation of an Electronic Bullet by David Fisher et al. explains the existing geo-pairing systems and is hereby incorporated by reference herein. As discussed above, there are errors which detract from the accuracy of a hit or miss. "An Analysis of the Effects of Orientation Sensing Errors on Geometric Pairing" b Bradley C. Shricker et al. describes the inherent errors in the existing geo-pairing systems and is hereby incorporated by reference herein. FIG. 7 is a simplified block diagram of the components of a Hybrid Non-Laser Pairing System (NLPS) 500 in another embodiment of the present invention. The NLPS 500 integrates a geo-paring system 502, with the shooting simulation system illustrated in FIG. 1, 4, or 6 to achieve precise pairing solutions. With NLPS, the firearm includes an orientation sensor, and a man-worn computer 504 and the optical system 14 having an optical image capturing device (e.g., a camera), mounted on the firearm, for capturing an image when the trigger is actuated. The man-worn computer may be any device having a processor. The optical system may include a digital camera having an optical path parallel to the firearm bore yielding a relatively narrow field of view. The center of the captured image may be a straight line projection of the firearm barrel (ignoring the slight offset of optical path mounting relative to gun barrel) and is where a bullet would strike if there were no forces, such as those due to gravity and aerodynamics. If geo-pairing data indicates that a target is possible at trigger pull, the image is then processed by the image recognition program to isolate a human (or other predetermined target) silhouette. The image recognition program is preferably located with the optical system in the shooting firearm. Using range and firearm inclination data, a ballistics computation may determine where, or if the simulated bullet intersects the silhouette. The target's identity may be known by the target's location on the area of operations. In one embodiment, a hit or near miss message may be transmitted to the target's firearm. If the target is obscured by dust, fog, or smoke, the geo-pairing system may still provide the results. Any inaccuracy would not cause any negative training feedback because the shooter's vision would also be obscured and would not know with certainty if the target was a hit or a miss. In areas where geo-pairing data is weak, intermittent, or unavailable, such as in urban terrain or indoors, the players in the system may wear special clothing (e.g., vests, headbands, armbands, etc.) printed with unique machine recognizable patterns to determine the target's individual identity.

By using geo-pairing data, object recognition may be simplified. For example, in one embodiment, if a target is not geometrically possible at trigger pull, then processing time will not be wasted on non-target images. When a target comes into the optical field of view, images may start to be processed by the optical system in anticipation of a trigger pull, thereby reducing processing time when the shot occurs. If the range of the target is known, then the approximate target image size may be known as well, thereby reducing the target search. Additionally, relative motion of the shooter and target may help in separating the target silhouette from the background. Reduced visibility or low-light exercises are also feasible with the NLPS 500 by using a Charge-Coupled Device (CCD) chip to capture an image. This chip has an inherent ability to detect near-IR signatures and may be designed to produce a silhouette image.

Furthermore, there are also other potential advantages of the NLPS as well. For example, errors in SNE are negated because the NLPS is able to determine if the target is covered or uncovered. Soldiers do not need to wear problematic electronic sensors. Near misses may be accurately measured and appropriate cues may be sent to the target indicating suppressing fire. After Action Reviews (AAR) commonly used in army exercise assessment, may utilize very detailed photos of hits or near misses.

Figure 8:
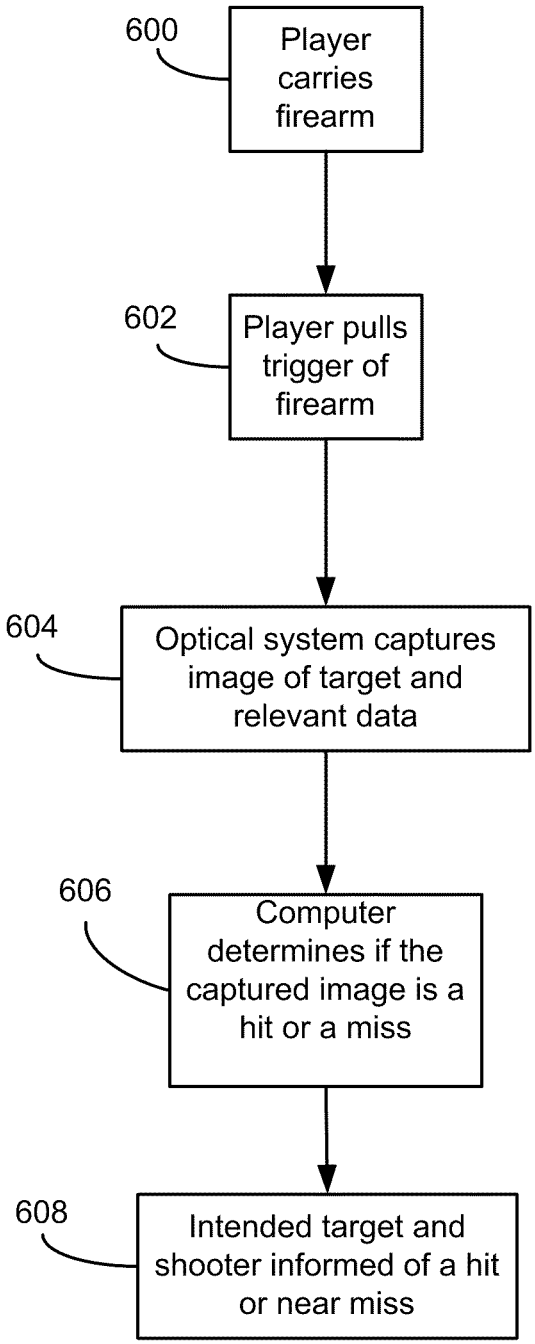
FIG. 8 is a flow chart illustrating the steps of simulating firearm use in a scenario according to the teachings of the present invention utilizing the NLPS system.

FIG. 8 is a flow chart illustrating the steps of simulating firearm use in a scenario according to the teachings of the present invention utilizing the NLPS system 500. With reference to FIGS. 1-8, the method will now be explained. In step 600, each player carries a firearm 12. In the preferred embodiment of the present invention, each player wears the indicia to facilitate ease in recognition by the optical system's recognition program of a legitimate target and specific identity of the player. Next, in step 602, a player observes another player and when desired, aligns the firearm in a similar fashion as if the player was aiming the firearm to actually fire and actuates the trigger 32. In step 604, the optical system 14 captures the image and relevant data concerning the firearm and environment (e.g., alignment, inclination, and heading of the barrel, any movement of the firearm, winds, altitude, etc.). In one embodiment, if the geo-pairing system 502 determines that a target is not near the intended bullet trajectory, the optical system may be prevented from processing an image. Furthermore, if it is determined that a target is near the intended bullet trajectory, the present invention may begin "pre-processing" of the image and associated information to expedite the actual processing of the information when the trigger is actually pulled.

In step 606, the man-worn computer 504 determines, through its image recognition program, if the image is a recognizable and valid target (i.e., a human form) and whether to score it as a hit or a miss. The computer may utilize several sources of information to verify the validity of the target. Furthermore, the computer includes ballistic data of a projected firing of a bullet to determine where the bullet would hit. The presence of the indicia 22 or a detected infrared emission (or other spectral image) of the opposing player may be used to determine if the target is a valid target. In addition, the rangefinder may optionally be used to determine an accurate projected trajectory of the bullet (i.e., the bullet ballistics) for the particular target at a determined range. As discussed above, the determination of a hit or miss within the optical system may utilize various forms of data. The orientation (e.g., heading and inclination) of the barrel of the firearm, distance to the target, weather conditions (wind, altitude, etc.), movement of the firearm, etc. are all used to determine the trajectory of the bullet. The calculated bullet's trajectory is then used to determine where the bullet would have hit, and from the determination of the bullet's destination, a determination of a hit or miss of a valid target is accomplished. The man-worn computer may utilize various navigation and motion systems to collect data for accurate determination of the bullet's trajectory and/or location of the firearm, such as GPS or INS. Furthermore, the computer utilizes all information derived from the geo-pairing system, such as location of the shooter, location of the target, time of the trigger pull, characteristics of the weapon and ammunition, orientation vector of the weapon, atmospheric conditions and terrain data. The computer 504 then records the captured image as a hit or a miss based on the image recognition programs determination. Furthermore, the optical system may utilize other ancillary identifiers to determine if the intended target is valid, such as detecting specific patterns (e.g., helmet, human face, assault rifle, camouflage clothing, boots, etc.). Next, in step 608, this information (i.e., hit or miss, trigger actuations, results, etc.) may then be transmitted to the opposing firearm (e.g., shooter and/or target).

In one embodiment of the present invention, the NLPS system (or the systems described in FIGS. 1, 4, and 6) may utilize a distributed network. In this network, the firearm (man-worn computer) communicates with one or more firearms (man-worn computer) using the wireless transmitters 16. Any necessary information is passed from one node (i.e., firearm or man-worn computer) to another without the need of a centralized computing system. In one embodiment, the wireless transmitter enables the use of a wireless network for communicating between each firearm/man-worn computer. In another alternate embodiment of the present invention, the NLPS system 500 may utilize a central computing system (not shown in FIG. 7). The image recognition program may reside with the central computing system or with the firearm 12. Furthermore, the hit or miss determination may be made either in the central computing system or the firearm as discussed in FIGS. 1 and 4.

The various components (e.g., parts of the optical system, wireless transmitter, image recording device, etc.) associated with each firearm in systems 10, 110, 400, and 500 may be worn by the player or integrated into the firearm. For example, the man-worn computer may be a separate component worn by the player and communicating with the firearm or may be integrated into the firearm.

The present invention provides many advantages over existing shooting simulation systems. The present invention does not require the wearing of sensors by players to detect a hit by a laser or other device. Thus, the cost of equipment is drastically reduced. Furthermore, the present invention enables the accurate calculation of a bullet's trajectory rather than the straight line of sign calculation used in laser simulation systems. In addition, the present invention provides for the carriage of light and cost-effective equipment (i.e., an optical system) for use on the firearm. The present invention may be incorporated in existing operation firearms or built into realistic replicas.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A shooting simulation system, the system comprising:

a plurality of firearms, each firearm being held by a separate player, wherein each player has a computer and an optical system associated with the firearm for capturing an image, the image providing information on a trajectory of a simulated bullet fired from a shooting firearm;

wherein the optical system is aligned relative to a known sight of the shooting firearm, the optical system capturing the image when a trigger of the shooting firearm is pulled;

an image recognition program for determining if the captured image is a legitimate target;

wherein the computer determines if the captured image is a hit or a miss of a targeted player, the computer using information obtained from the optical system and image recognition program for determining if the captured image is a hit or a miss of a targeted player, wherein the optical system detects a predetermined indicia of the targeted player in the captured image to determine if the targeted player is a legitimate target.

2. The system according to claim 1 wherein the computer:

utilizes a position of the targeted firearm and the shooting firearm to determine an identity of the target; and utilizes an orientation of the shooting firearm to determine an identity of the target.

3. The system according to claim 1 wherein the computer is separate from the firearm configured to be worn by the player.

4. The system according to claim 1 wherein the computer utilizes a projected trajectory of notional ammunition used in the shooting firearm to determine a hit or miss of the targeted player.

5. The system according to claim 1 further comprising a warning system for informing the computer of the targeted player of a hit by the shooting firearm.

6. The system according to claim 5 further comprising a central computing system communicating with each firearm, the central computing system having the warning system for informing a computer of the targeted player of a hit by the shooting firearm.

7. The system according to claim 6 wherein the central computing system verifies a hit or miss for each captured image and compiles hits or misses of each firearm in use in the system.

8. The system according to claim 1 wherein the optical system detects a predetermined pattern associated with a valid target.

9. The system according to claim 1 wherein the indicia provides an identification of a specific person.

10. The system according to claim 1 further comprising a spectral imaging system to determine if the captured image is a hit or a miss of the targeted player.

11. The system according to claim 1 further comprising a geo-pairing system for determining an identity of the target.

12. The system according to claim 1 wherein each computer communicates via a wireless transmitter to a wireless network.

13. The system according to claim 1 wherein the indicia is a pattern affixed to clothing of each player.

14. The system according to claim 1 wherein the image recognition program detects a specific pattern or shape within the captured image to determine if the captured image is a legitimate target.

15. A method of simulating firearm use between a plurality of players, the method comprising the steps of:

pulling a trigger of a shooting firearm, the shooting firearm aiming at a targeted player;

capturing an image by an optical system associated with the shooting firearm, the image providing information on a trajectory of a simulated bullet fired from the shooting firearm, the optical system aligned relative to a known sight of the shooting firearm, the optical system capturing the image when a trigger of the shooting firearm is pulled;

determining if the captured image is a valid hit or a miss of the targeted player;

wherein the step of determining if the captured image is a valid hit or a miss of the target player includes the steps of:

using an image recognition program for determining if the captured image is a legitimate target;

using information obtained from the optical system and image recognition program for determining if the captured image is a hit or a miss of a targeted player, and detecting a predetermined indicia associated with the targeted player, wherein the optical system detects the predetermined indicia in the captured image to determine if the targeted player is a legitimate target.

16. The method according to claim 15 wherein the step of determining if the captured image is a hit or miss includes the step of using a position of the targeted player and the shooting firearm to determine an identity of the targeted player.

17. The method according to claim 15 wherein the step of determining if the captured image is a hit or miss includes the step of using an orientation of the shooting firearm to determine an identity of the targeted player.

18. The method according to claim 15 wherein the step of determining if the captured image is a hit or miss includes the step of using a projected trajectory of notional ammunition used in the shooting firearm to determine an identity of the targeted player.

19. The method according to claim 15 further comprising the step of informing a man-worn computer associated with the shooting firearm of a hit on the target.

20. The method according to claim 15 further comprising the steps of:

verifying a hit or miss for each captured image by a central computing system communicating with each firearm of the plurality of firearms; and compiling hits or misses of each firearm in use by the central computing system.

21. The method according to claim 15 further comprising the step of detecting a predetermined pattern associated with the targeted player by the optical system.

22. The method according to claim 15 wherein the indicia provides an identification of a specific person.

23. The method according to claim 15 wherein the step of determining if the captured image is a hit or a miss of the targeted player includes the step of utilizing spectral imaging to determine if the captured image is a hit or a miss of the targeted player.

24. The method according to claim 15 wherein the step of determining if the captured image is a hit or a miss of the targeted player includes using a geo-pairing system for determining an identity of the targeted player.

25. The method according to claim 15 further comprising the step of informing the targeted player of a hit by the shooting firearm, including transmitting via a wireless transmitter to a wireless network.

26. The method according to claim 15 further comprising the step of informing the targeted player of a hit by the shooting firearm.

* * * * *